US008653750B2

(12) United States Patent
Deurenberg et al.

(10) Patent No.: US 8,653,750 B2
(45) Date of Patent: Feb. 18, 2014

(54) METHOD OF CONTROLLING AN ELECTRONIC BALLAST, AN ELECTRONIC BALLAST AND A LIGHTING CONTROLLER

(75) Inventors: Peter Hubertus Franciscus Deurenberg, S-Hertogenbosch (NL); Gert-Jan Koolen, Aarle Rixtel (NL); Victor Zwanenberg, Boxtel (NL)

(73) Assignee: NXP B.V., Eindhoven (NL)

( * ) Notice: Subject to any disclaimer, the term of this patent is extended or adjusted under 35 U.S.C. 154(b) by 136 days.

(21) Appl. No.: 13/296,803

(22) Filed: Nov. 15, 2011

(65) Prior Publication Data

US 2012/0119652 A1 May 17, 2012

(30) Foreign Application Priority Data

Nov. 17, 2010 (EP) ..... 10191526

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.
USPC ..... 315/291; 315/185 R; 315/302; 315/307

(58) Field of Classification Search
None
See application file for complete search history.

(56) References Cited

U.S. PATENT DOCUMENTS

| | | | | |
|---|---|---|---|---|
| 6,175,195 | B1 | 1/2001 | Janczak et al. | |
| 7,936,132 | B2 | 5/2011 | Quek et al. | |
| 2003/0209997 | A1 | 11/2003 | St-Germain et al. | |
| 2006/0192502 | A1 | 8/2006 | Brown et al. | |
| 2007/0182347 | A1 | 8/2007 | Shteynberg et al. | |
| 2008/0048573 | A1 | 2/2008 | Ferentz et al. | |
| 2008/0203934 | A1 | 8/2008 | Van Meurs | |
| 2009/0251059 | A1 | 10/2009 | Veltman | |
| 2009/0295300 | A1 | 12/2009 | King | |
| 2010/0213870 | A1 | 8/2010 | Koolen | |
| 2011/0140620 | A1* | 6/2011 | Lin et al. | 315/224 |
| 2012/0126714 | A1* | 5/2012 | Deppe et al. | 315/192 |

FOREIGN PATENT DOCUMENTS

| | | | |
|---|---|---|---|
| GB | 2 205 206 | A | 11/1988 |
| GB | 2 435 724 | A | 9/2007 |
| WO | 2008/029108 | A1 | 3/2008 |
| WO | 2010/011971 | A1 | 1/2010 |

(Continued)

OTHER PUBLICATIONS

"SSL2102 Mains LED driver IC for dimmable LED lighting," NXP Semiconductors, data sheet, 21 pgs. (Jun. 2009).

(Continued)

*Primary Examiner* — Anh Tran

(57) ABSTRACT

A method of controlling an electronic ballast for a lighting circuit, the ballast including a bleeder, for use with dimmer circuits, by, in response to a mains supply being connected to the lighting circuit, determining whether a dimmer circuit is present in the lighting circuit; and in response to determining a dimmer circuit is not present, disconnecting the bleeder from the lighting circuit at least until the mains supply is disconnected. The method may be used during start, and the determination of whether a dimmer circuit is present is stored at least until the mains supply is disconnected. Determination of either a leading or trailing edge phase cut dimmer may be made by looking for deviation from the expected sine-wave voltage, either directly through temporal or voltage deviation, or indirectly by examining the second differential of the voltage with respect to time.

14 Claims, 5 Drawing Sheets

(56) References Cited

FOREIGN PATENT DOCUMENTS

| | | | |
|---|---|---|---|
| WO | 2010/016002 | A1 | 2/2010 |
| WO | 2010/137002 | A1 | 12/2010 |
| WO | WO 2011013060 | A2 * | 2/2011 |

OTHER PUBLICATIONS

"SSL2101 SMPS IC for dimmable LED lighting," NXP Semiconductors, data sheet, 22 pgs. (Aug. 2009).

"56W Off-line, 120VAC with PFC, 160V, 350mA Load, Dimmer Switch Compatible LED Driver," Supertex inc. Design Note DN-H05, 19 pgs. (2009).

"SSL2103 SMPS controller IC for dimmable LED lighting," NXP Semiconductors, data sheet, 21 pgs. (Aug. 2011).

Extended European Search Report for European Patent Appln. No. 10191526.2 (May 25, 2011).

* cited by examiner

METHOD OF CONTROLLING AN ELECTRONIC BALLAST, AN ELECTRONIC BALLAST AND A LIGHTING CONTROLLER

CROSS-REFERENCE TO RELATED APPLICATIONS

This application claims the priority under 35 U.S.C. §119 of European patent application no. 10191526.2, filed on Nov. 17, 2010, the contents of which are incorporated by reference herein.

FIELD OF THE INVENTION

This invention relates to method of controlling electronic ballasts for lighting circuits, and to electronic ballasts for lighting circuits.

BACKGROUND OF THE INVENTION

There is an increasing interest in energy efficient lighting to replace conventional incandescent bulbs, not least because of environmental concerns. Whereas compact fluorescent lamps (CFL) presently dominate energy efficient lighting, there is an increasing move towards light emitting diode (LED) lighting, since this offers the prospect of a significant reduction in energy consumption, with respect even to CFL.

However, in common with CFL, LED lighting typically takes the form of a high ohmic load. This presents challenges for existing lighting circuits incorporating a dimmer circuit: the most common types of dimmer circuits are phase cut dimmers, in which the mains supply is cut off for part of the mains cycle—either the leading edge of the cycle or half-cycle, or its trailing edge. Most trailing edge dimmers are based on a transistor circuit, whereas most leading edge dimmers are based on a triac circuit. Both transistor and triac dimmers require to see a low ohmic load.

To satisfy this requirement, it is known to provide LED driver circuits (also known as electronic ballasts), with a "bleeder", which presents a relatively low ohmic load to the dimmer circuit in order to ensure that it operates correctly. However, if the circuit including bleeder is connected to a non-dimmable mains connection, the bleeder operates unnecessarily, resulting in an efficiency drop, which typically can be up to 10%, and potentially increased electromagnetic interference (EMI) problems if the bleeder is dynamically controlled.

An LED driver circuit is known in which the bleeder may be disconnected in the absence of a dimmer circuit. Such a circuit is disclosed for instance in United Kingdom Patent Application publication GB-A-24357264.

SUMMARY OF THE INVENTION

It is an object of the present invention to provide method of controlling a electronic ballast for a lighting circuit, and a method of controlling the same, which more effectively avoids bleeder losses when a bleeder is not required. It is a further objective to provide a method for adapting the bleeder losses in dependence on a dimmer circuit when present.

According to the invention there is provided a method of controlling an electronic ballast for a lighting circuit and having a bleeder for use with dimmer circuits, the method comprising: in response to a mains supply being connected to the lighting circuit, determining whether a dimmer circuit is present in the lighting circuit; and in response to determining that a dimmer circuit is not present, disconnecting the bleeder from the lighting circuit at least until the mains supply is disconnected, wherein determining whether a dimmer circuit is present in the lighting circuit comprises checking a parameter indicative of the presence of a dimmer during each of a plurality of mains cycles, and determining whether the dimmer is present in dependence on either the ratio or absolute number of the checks which indicate that a dimmer is present. By checking over a plurality of mains cycles, the reliability is significantly improved, since for instance the effects of noise or spikes on the line can be eliminated.

In embodiments, the plurality of mains cycles is at least the first 8 mains cycles from a moment when the mains supply is connected to the lighting system, and or in the alternative may be no more than the first 25 mains cycles or 15 mains cycles from a moment when the mains supply is connected to the lighting system. It will be appreciated that a smaller number of mains cycles may be used—even as few as 2 cycles, provided only that there is a plurality. A convenient range is between 15 and 25 mains cycles, corresponding to 300 ms to 500 ms, since this generally corresponds to the speed of human interaction. A particularly preferred number of mains cycles, to adapt the bleeder current according to embodiments is 8 or approximately 8 cycles.

In embodiments information relating to whether a dimmer circuit is present is stored at least until the mains supply is disconnected. Thus a single set of measurements may be made when the mains is connected, and the result assumed to hold true all the while the mains is connected. This is appropriate, as it is exceedingly unlikely that a dimmer circuit could be added to, or removed from, the lighting circuit whilst the mains is on and the lighting is operating.

In embodiments, the parameter is a time interval during which the rectified voltage is less than a predetermined voltage threshold, and wherein the time interval being more than a predetermined threshold interval is indicative that a dimmer circuit is present. In other embodiments, the parameter is a voltage at the end of a predetermined delay from a predetermined phase of the mains cycle, and wherein the voltage being more than a predetermined threshold voltage is indicative that a dimmer circuit is present. In further embodiments, the parameter is the second differential, with respect to time, of the mains voltage, and wherein the parameter exceeding a predetermined absolute detection level is indicative that a dimmer circuit is present. In yet other embodiments, the parameter is the first differential, with respect to time, of the mains voltage, and wherein the parameter exceeding a predetermined absolute detection level is indicative that a dimmer circuit is present.

In embodiments, in response to determining that a dimmer circuit is present, a bleed current through the bleeder is adjusted in dependence on the dimmer circuit. This the invention can accommodate differing types of bleeders, and the type need not be known a priori, resulting in a more versatile circuit.

In embodiments, adjusting an impedance of the bleeder comprises setting the bleed current through the bleeder to an initial value, measuring a voltage representative of the voltage across the bleeder, and if the voltage representative of the voltage across the bleeder does not exceed a predetermined limit, decreasing the current through the bleeder.

According to another aspect of the invention, there is provided an electronic ballast for a lighting circuit, comprising a circuit for determining whether a dimmer circuit is present in the lighting circuit, a storage means for storing the determination whether a dimmer circuit is present, and a bleeder for use with dimmer circuits and arranged to be disconnected from the lighting circuit in the absence of a dimmer circuit.

In embodiments, the circuit for determining whether a dimmer circuit is present in the lighting circuit is operable to check a parameter indicative of the presence of a dimmer during each of a plurality of mains cycles, and to determine whether the dimmer circuit is present in dependence on either the ratio or absolute number of checks which indicate that a dimmer circuit is present.

In embodiments, at least one of: (a) the parameter is a time interval during which the rectified voltage is less than a predetermined voltage threshold, such that the time interval being less than a predetermined threshold interval is indicative that a dimmer circuit is present; (b) the parameter is a voltage at the end of a predetermined delay from a predetermined phase of the mains cycle, such that the voltage being more than a predetermined threshold voltage is indicative that a dimmer circuit is present; (c) the parameter is the second differential of the mains voltage, such that the parameter exceeding a predetermined absolute detection level is indicative that a dimmer circuit is present, and (d) the parameter is the second differential of the mains voltage, such that the parameter exceeding a predetermined absolute detection level is indicative that a dimmer circuit is present.

According to another aspect of the invention, there is provided an LED lighting controller comprising an electronic ballast as just described.

These and other aspects of the invention will be apparent from, and elucidated with reference to, the embodiments described hereinafter.

BRIEF DESCRIPTION OF DRAWINGS

Embodiments of the invention will be described, by way of example only, with reference to the drawings, in which.

Figure 1:
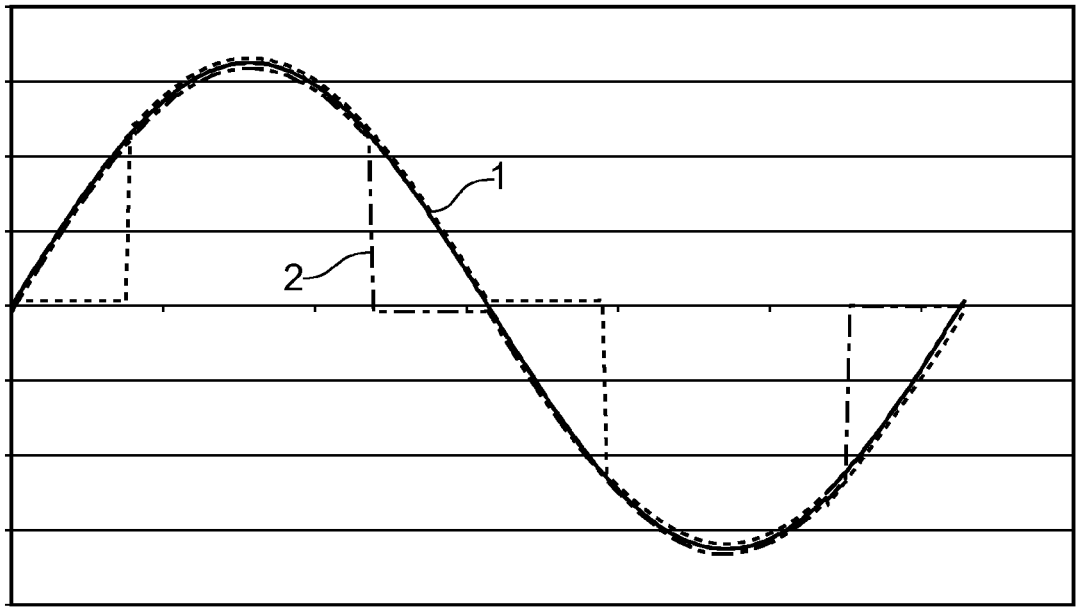
FIG. 1 illustrates idealised voltages for phase cut mains dimmers with each of leading edge and trailing edge phase cut.

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar feature in modified and different embodiments

DETAILED DESCRIPTION OF EMBODIMENTS

Figure 2:
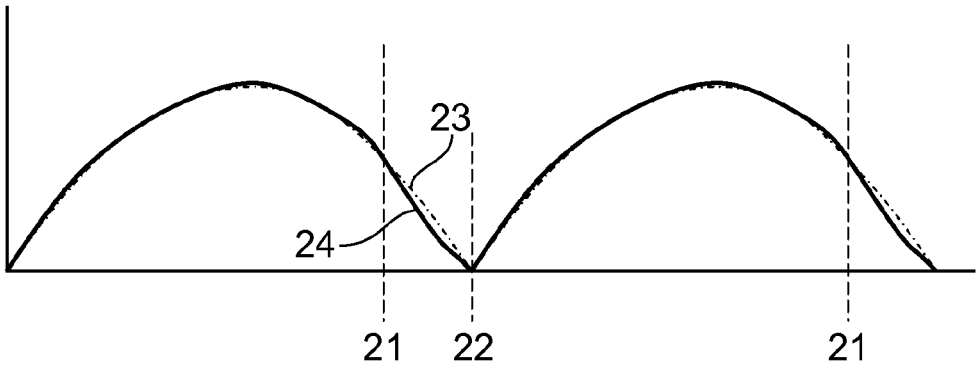
FIG. 2 illustrates a realistic mains voltage for a trailing edge phase cut mains dimmer with a high-ohmic load.

FIG. 1 illustrates idealised voltages for phase cut mains dimmers with each of leading edge and trailing edge phase cut; the leading edge phase cut, such as would be produced by a triac dimmer, but also frequently produced by transistor dimmers, is shown by curve 1 (dashed line), and the trailing edge phase cut, such as can be produced by transistor dimmers, is shown by curve 2 (dashed line). Each curve is shown slightly displaced in the vertical direction from the other, in order to show where they do and do not overlap. For a low ohmic load such as an incandescent light, the voltage closely matches the idealised voltage shown. However, for a high ohmic load, such as a DC-DC converter for use in conjunction with either LED CFL lighting, the voltage does not closely follow the idealised version: FIG. 2 illustrates a realistic mains voltage for a trailing edge phase cut mains dimmer with a high-ohmic load. Again, the actual voltage 24 is shown slightly displaced in a vertical direction from the sine wave 23, and in this diagram the rectified voltage is shown, rather than the un-rectified voltage of FIG. 1. Whereas for a low ohmic load, the voltage would fall directly to zero at moment 21 and remain at zero until the nominal zero crossing moment 22, for a high ohmic load, the actual voltage 24 does not fall so rapidly, and might more nearly follow the un-cut sine wave 23: the voltage only slowly decreases to zero over the same period as the mains supply voltage itself. This diagram illustrates that to detect the presence of a dimmer, it would generally be inadequate, in the case of a high ohmic load, to merely look for a zero voltage at a moment after 21, as might be suggested by the curves shown in FIG. 1.

Moreover, the presence of mains disturbances due to other connected equipment, which disturbances can be particularly prevalent in less closely regulated environments, further hamper the accurate detection of the presence of a dimmer.

Figure 3:
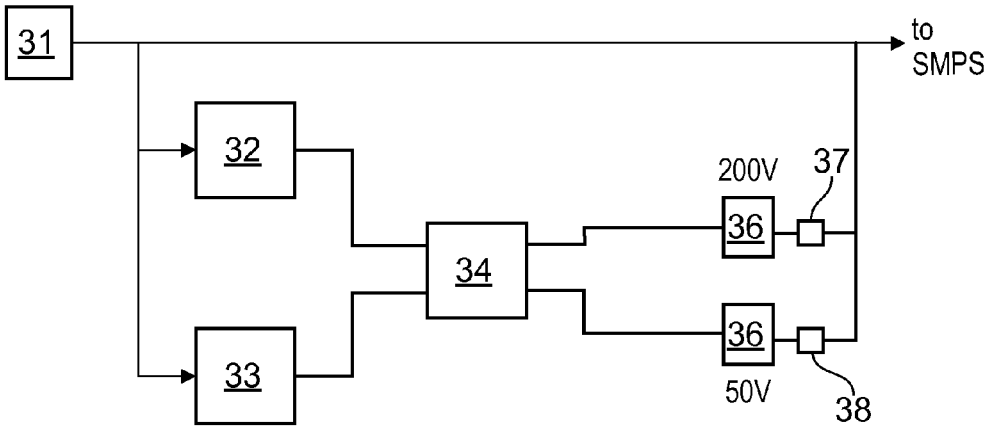
FIG. 3 shows a block diagram of part of an existing LED drive circuit, having both a strong and a weak bleeder.

FIG. 3 shows a block diagram of part of an existing LED drive circuit, such as the SSL2105 driver available from NXP Semiconductors, which is able to differentiate between different types of dimmers which may be present, and which has both a strong and a weak "bleeder". In this example, both strong an weak bleeder functionality is combined into a single controllable element. In other devices (such as the SSL2101 and SSL2103 drivers also available from NXP Semiconductors), the strong and weak bleeder functionality may be provided separately. The "bleeders" will be explained in more detail hereinbelow. The drive circuit comprises a mains-connectable bridge rectifier 31, which is connected to the switch mode power supply SMPS. The output of the bridge rectifier 31 is connected to a transistor detector 32, as well as to a triac detector 33. Outputs from each of the transistor detector 32 and triac detector 33 are input to a logic circuit 34, which is used to determine whether a dimmer is connected, and if so, which type of dimmer (triac or transistor) is present. The logic is set to enable, by means of respective enablers 35 and 36, at least one of the weak bleeder 37 and strong bleeder 38: if the logic 34 determines to that a transistor dimmer is more likely to be present, it permanently enables the weak bleeder; however, if the logic determines in the alternative that a triac detector is more likely to be present, it enables the weak bleeder if the bridge rectifier voltage is less than 200 V, and the strong bleeder if the bridge rectifier voltage is less than 50 V. If the voltage is more than 200V, neither bleeder is enabled.

Figure 4:
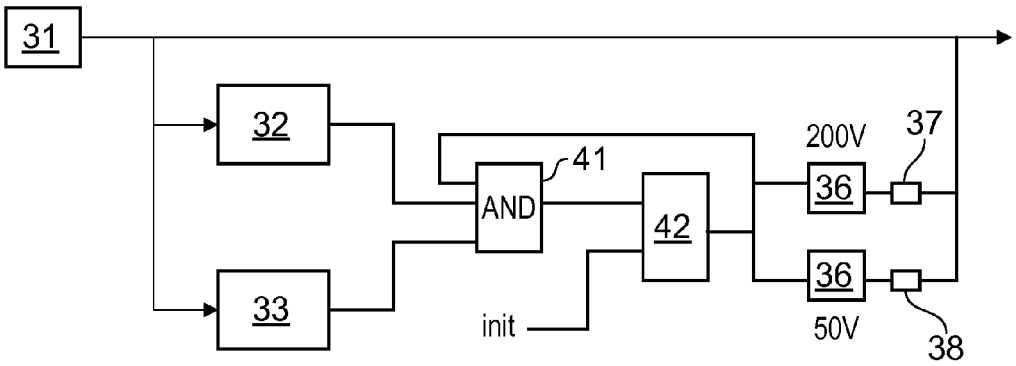
FIG. 4 shows a block diagram of part of an LED drive circuit according to an embodiment of the invention.

FIG. 4 shows a block diagram of part of an LED drive circuit according to an embodiment of the invention. This circuit is substantially similar to that shown in FIG. 3; however, in this case, instead of the outputs of the respective transistor and triac detectors 32 and 33 being input to logic circuit 34, a "not present" output from each is provided as two of the three inputs of a three-input AND circuit. The output of the AND circuit is input to the "reset" input of a S-R flip-flop 42. The "set" input to the flip-flop is provided from an initial signal init. Threshold detectors 36 measure the rectified mains voltage, and when this voltage is not reached, and the box is enabled with signal from 42, either or both of the strong and weak bleeder 37 and 38 respectively are activated.

Figure 5:
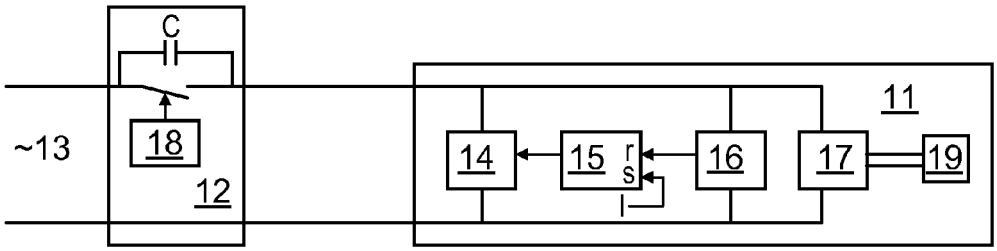
FIG. 5 shows a block diagram of an LED lighting a circuit according to an embodiment of the invention.

FIG. 5 shows a block diagram of an LED lighting circuit according to an embodiment of the invention. The figure shows lighting unit 11, which is connected by means of a dimmer 12 to a mains input 13. The dimmer 12 includes a snubber capacitor C and a timing switch 18 which may be either a transistor or a triac. The lighting unit 11 comprises a bleeder unit 14 which is controlled by a S-R flip-flop 15. the set input to the flip-flop 15 is provided by an initial signal init, and the reset input to the flip-flop 15 is provided from a dimmer detection unit 16. The lighting unit 11 further comprises a SMPS 17, which is connected to the mains in parallel with the dimmer bleeder unit 14 and the detection unit 16. As shown at 19, one or more individual lamps, which may in particular be one or a plurality of strings of LEDs, are powered by means of the SMPS 17.

Figure 6:
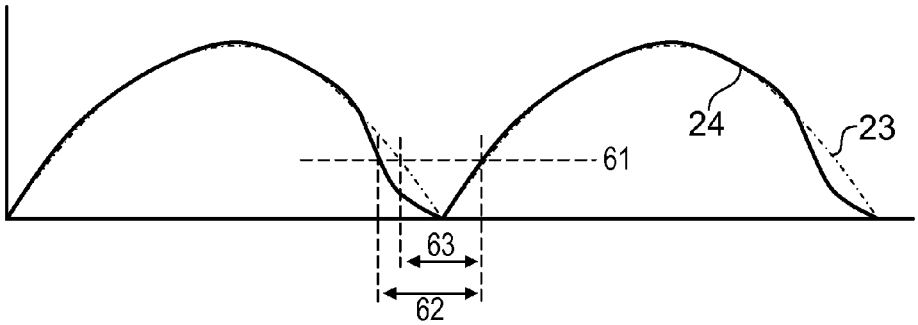
FIG. 6 shows a temporal detection method for the presence of a dimmer.

FIG. 6 shows a temporal detection method for the presence of a dimmer. FIG. 6 shows a rectified input without a phase cut dimmer being present in dashed curve 23, and with a phase cut dimmer present in solid curve 24. In this detection method, a reference voltage level 61 is predetermined. The reference voltage level 61 is chosen sufficiently low as to be less than a typical voltage at which the phase is cut. For instance the voltage may be chosen to be 50 V for a 230 V mains. The time interval over which the rectified input 24 voltage is less than the reference voltage level 61 is measured, using for instance a conventional passive RC high-pass filter, or an operational amplifier set for differential detection. From the fact that an un-phase cut rectified input voltage follows a sine curve, through knowledge of the mains frequency, the mains voltage and the reference voltage level, it is a simple matter to calculate the expected time interval 62 for an un-phase cut signal. If the actual time interval 63 be significantly less than the calculated interval 63, it can be concluded that a phase cut dimmer is present.

Figure 7:
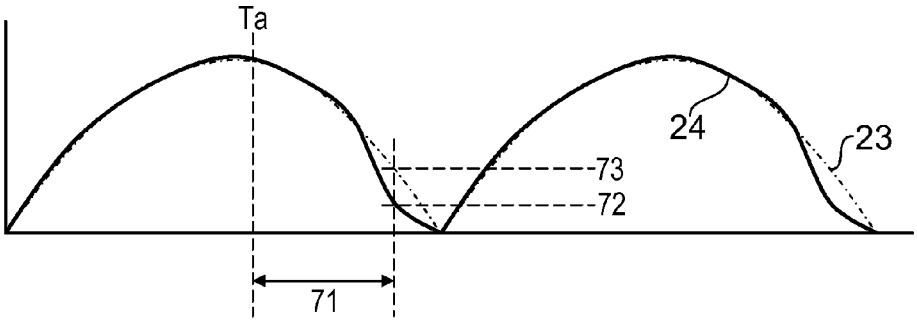
FIG. 7 shows a voltage detection method for the presence of a dimmer.

An alternative detection method is illustrated in FIG. 7. FIG. 7 shows a voltage detection method for the present of a dimmer, and again shows two curves; one (24) with a phase cut dimmer presence, and the other (23) without any phase cut dimmer. In this method, the absolute peak of the mains value is found, at Ta. The voltage is then measured after a fixed interval 71. Once again, by simple trigonometry, knowing the frequency of the mains, the expected vaulted 73 corresponding to the case that there is no phase cut dimmer present is easily calculated. Should the actual voltage 72 be significantly different from the expected voltage 73, it is concluded that a phase cut dimmer is present. It is noted that, in general, this method gives a more stable indication compared with the solution discussed above with reference to FIG. 6. Further, the difference may also be detected either by checking the time it takes for the mains voltage to drop from a first reference value, such 200V when a strong bleeder may conventionally be turned on, to below a second reference value, 61, such as for instance 50V. If the time interval is less than that expected due to trigonometric calculations from the expected sine curve, it may be concluded that is a transistor dimmer is present.

Figure 8:
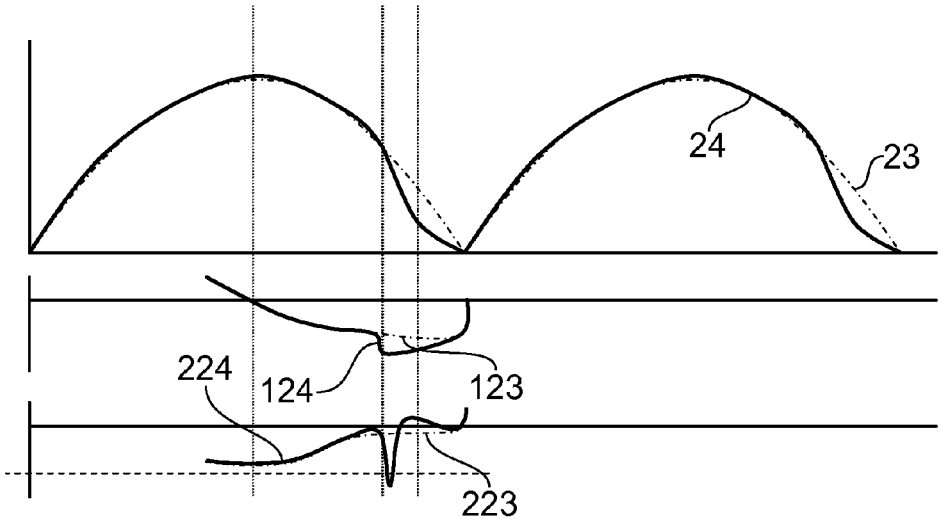
FIG. 8 shows the first and second time differential of the voltage, illustrating further detection methods for the presence of a dimmer.

FIG. 8 shows the first and second time differential of the voltage, illustrating further detection methods for the presence of a dimmer. The figure shows the same input voltage 23 and 24 as shown in FIGS. 6 and 7, a but in this case also shows the first differential of the voltage, at 124 and 123, corresponding to the cases with and without a phase cut present respectively, as well as the second differential the voltage, at respectively 224 and 223.

Figure 11A:
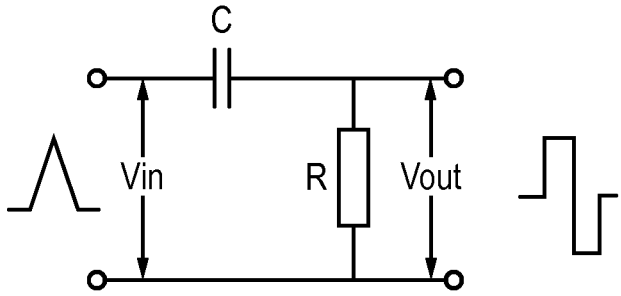
FIG. 11 shows, examples of analogue circuits, at FIGS. 11(*a*) and 11(*b*) for deriving a first differential of a voltage, and at FIG. 11(*c*) for deriving a second differential of a voltage.
Figure 11B:
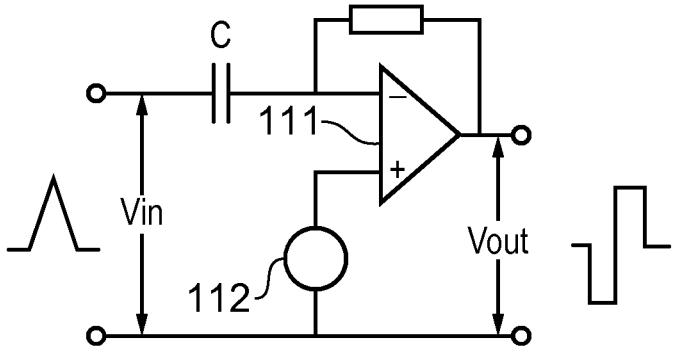
Figure 11C:
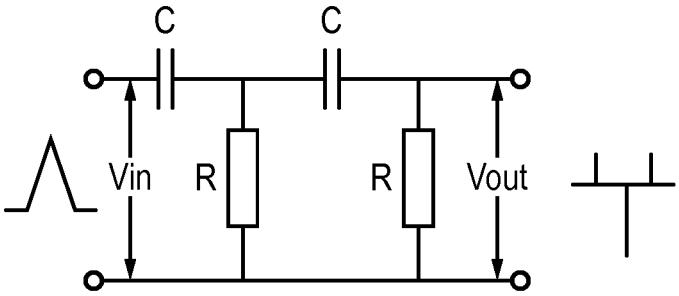

The skilled person will readily understand how to derive the first and second differential of the voltage, as illustrated in FIG. 8, in an analogue circuit. The first differential may be obtained, for instance, by a passive circuit comprising a series capacitor C, followed by a resistor R across the output, as shown in FIG. 11(*a*). An non-exclusive alternative arrangement is a circuit with an operational amplifier (111) having a current source (112) added to a resistor/capacitor combination, as illustrated in FIG. 11(*b*). A combination of two such circuit (for instance as shown in FIG. 11(*c*)) will result in the second differential.

These further methods are based on the fact that at relatively low voltages, for instance between between −100V and +100V, 230V mains supply the mains voltage changes in an approximately linear way, according to a Taylor expansion of the sine function:

$$\sin x = \sum_{n=0}^{\infty} \frac{(-1)^n}{(2n+1)!} x^{2n+1} = x - \frac{x^3}{3!} + \frac{x^5}{5!} - \ldots \text{ for all } x$$

This means that the first derivative only shows minor fluctuations and the second derivative is therefore nearly zero, that is to say, $$\frac{d(\sin t)}{dt} = 1 - \frac{t^2}{2!} + h.o.t.$$

$$\frac{d^2(\sin t)}{dt^2} = -t + h.o.t$$

(where h.o.t indicates higher order terms.)

If a transistor dimmer is connected, the absolute value of the second derivative will be substantially higher, because the mains voltage drops to zero much faster than the regular mains without phase-cutting as shown in FIG. 8. Therefore, if the second derivative of the mains voltage is monitored and its absolute value exceeds a certain level, as shown at the peak of 224, it can be concluded that a transistor dimmer is connected. It will be appreciated that a directly analogous method can be used for leading edge phase-cut dimmers, either transistor or triac; however, in this case, the second derivative will be positive. Further, for triac leading dimmers, the voltage at switching is generally close to zero, so they display a much steeper slope, as a result of which detection is easier Moreover, the first derivative can also be used to detect the presence of a dimmer: in the presence of the dimmer, there is an increase in the absolute magnitude of the first derivative, as can be seen as 124, above that expected for the regular mains voltage without phase-cutting. This method can also be applied to leading edge dimmers—similarly to the second derivative method, in this case the first derivative will be positive.

Figure 9:
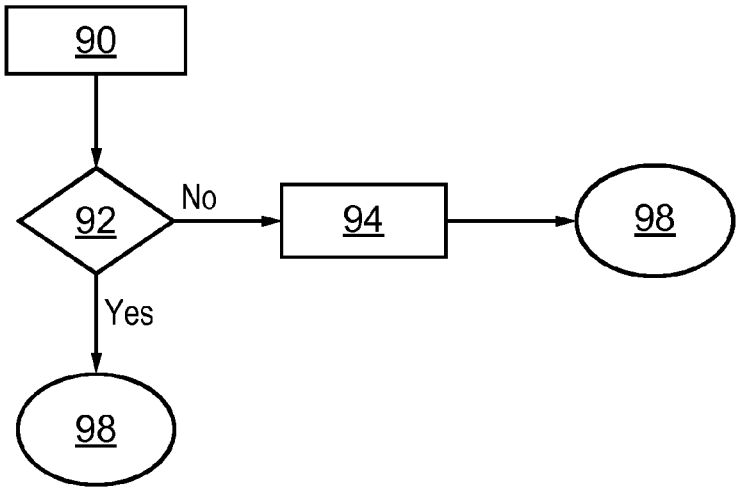
FIG. 9 is a block diagram of a method according to embodiments of the invention.

FIG. 9 is a block diagram of a method according to embodiments of the invention. From a start state 90, when a mains supply is connected to the lighting circuit, it is determined at 92 whether a dimmer circuit is present in the lighting circuit; if it is determined that a dimmer is present, the method ends at 98. However, if it is determined that a dimmer circuit is not present, the method continues at 94 by disconnecting the bleeder from the lighting circuit at least until the mains supply is disconnected, and then ends at 98. In the method, determining whether a dimmer circuit is present in the lighting circuit comprises checking a parameter indicative of the presence of a dimmer during each of a plurality of mains cycles, and determining whether the dimmer is present in dependence on either the ratio or absolute number of the checks which indicate that a dimmer is present.

Figure 10:
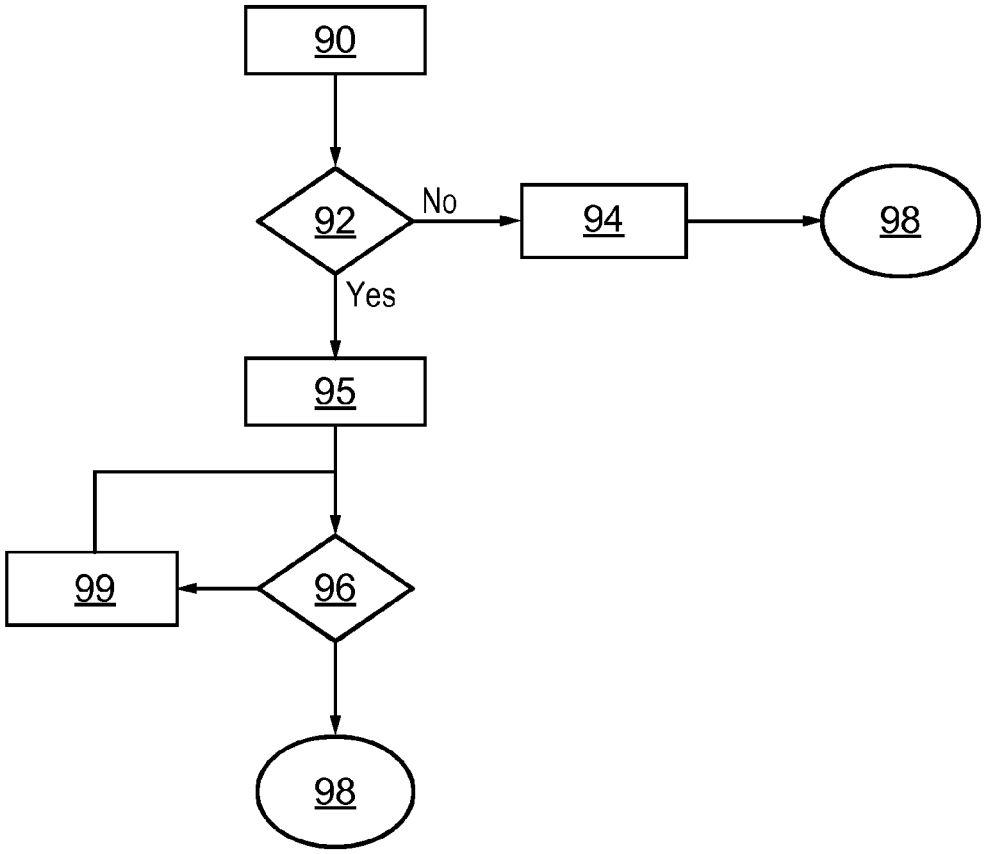
FIG. 10 is a block diagram of a method according to other embodiments of the invention.

FIG. 10 is a block diagram of a method according to another embodiment of the invention. This method is similar to that shown in FIG. 9, in that the method commences at a start state 90: when a mains supply is connected to the lighting circuit, it is determined at 92 whether a dimmer circuit is present in the lighting circuit; if it is determined that a dimmer circuit is not present, the method continues at 94 by disconnecting the bleeder from the lighting circuit at least until the mains supply is disconnected, and then ends at 98. However, in this method, if it determined that a dimmer circuit is present, a bleed current through the bleeder is adjusted in dependence on the dimmer circuit. In more detail the bleed current through the bleeder is set to an initial value at 95, a voltage representative of the voltage across the bleeder is measured at 96, and if the voltage representative of the voltage across the bleeder does not exceed a predetermined limit, the current through the bleeder is decreased at 94. This is repeated until if the voltage representative of the voltage across the bleeder exceeds the predetermined limit, at which point the method stops at 98. A particularly preferred number of mains cycles, to adapt the bleeder current according to embodiments is 8 or approximately 8 cycles.

Thus, from one viewpoint, there has been disclosed a method of controlling an electronic ballast for a lighting circuit, the electronic ballast comprising at least one bleeder, for use with dimmer circuits, is disclosed which method comprises: in response to a mains supply being connected to the lighting circuit, determining whether a dimmer circuit is present in the lighting circuit; and in response to determining that a dimmer circuit is not present, disconnecting the bleeder from the lighting circuit at least until the mains supply is disconnected. The method may be operable during a start-up phase, and the determination as to whether a dimmer circuit is present stored at least until the mains supply is disconnected. The determination, of either a leading or trailing edge phase cut dimmer, may be made by looking for a deviation from the expected sine-wave voltage, either directly through a temporal or voltage deviation, or indirectly by examining the second differential of the voltage with respect to time. An electronic ballast configured to operate such a method, and a lighting controller incorporating such a ballast, are also disclosed.

From reading the present disclosure, other variations and modifications will be apparent to the skilled person. Such variations and modifications may involve equivalent and other features which are already known in the art of phase-cut dimmers, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination.

The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, a single processor or other unit may fulfill the functions of several means recited in the claims and reference signs in the claims shall not be construed as limiting the scope of the claims.

The invention claimed is:

1. A method of controlling an electronic ballast for a lighting circuit and having a bleeder for use with a dimmer circuit, the method comprising:

in response to a mains supply being connected to the lighting circuit, determining whether a dimmer circuit is present in the lighting circuit; and in response to determining that a dimmer circuit is not present, disconnecting the bleeder from the lighting circuit at least until the mains supply is disconnected, wherein the determining whether a dimmer circuit is present in the lighting circuit comprises checking a parameter indicative of the presence of a dimmer during each of a plurality of mains cycles, and determining whether the dimmer is present in dependence on one of a ratio or an absolute number of the checks which indicate that a dimmer is present; and storing information relating to whether a dimmer circuit is present at least until the mains supply is disconnected.

2. The method of claim 1, wherein the plurality of mains cycles is at least the first 8 mains cycles from a moment when the mains supply is connected to the lighting system.

3. The method of claim 1, wherein the plurality of mains cycles is no more than the first 25 mains cycles from a moment when the mains supply is connected to the lighting system.

4. The method of claim 1, wherein the plurality of mains cycles is no more than the first 15 mains cycles from a moment when the mains supply is connected to the lighting system.

5. The method of claim 1, wherein the parameter is a time interval during which a rectified voltage is less than a predetermined voltage threshold, and wherein the time interval being more than a predetermined threshold interval is indicative that a dimmer circuit is present.

6. The method of claim 1, wherein the parameter is a voltage at an end of a predetermined delay from a predetermined phase of the mains cycle, and wherein the voltage being more than a predetermined threshold voltage is indicative that a dimmer circuit is present.

7. The method of claim 1, wherein the parameter is a second differential, with respect to time, of the mains voltage, and wherein the parameter exceeding a predetermined absolute detection level is indicative that a dimmer circuit is present.

8. The method of claim 1, wherein the parameter is a first differential, with respect to time, of the mains voltage, and wherein the parameter exceeding a predetermined absolute detection level is indicative that a dimmer circuit is present.

9. The method of claim 1, further comprising adjusting a bleed current through the bleeder in dependence on the dimmer circuit in response to determining that a dimmer circuit is present.

10. The method of claim 8, wherein adjusting an impedance of the bleeder comprises setting the bleed current through the bleeder to an initial value, measuring a voltage representative of the voltage across the bleeder, and if the voltage representative of the voltage across the bleeder does not exceed a predetermined limit, decreasing the current through the bleeder.

11. An electronic ballast for a lighting circuit, comprising a circuit for determining whether a dimmer circuit is present in the lighting circuit, a storage that stores the determination whether a dimmer circuit is present, and a bleeder for use with dimmer circuits and arranged to be disconnected from the lighting circuit in the absence of a dimmer circuit.

12. An electronic ballast according to claim 11, where the circuit for determining whether a dimmer circuit is present in the lighting circuit is operable to check a parameter indicative of the presence of a dimmer during each of a plurality of mains cycles, and to determine whether the dimmer circuit is present in dependence on one of a ratio or an absolute number of checks which indicate that a dimmer circuit is present.

13. An electronic ballast according to claim 12, wherein at least one of:

(a) the parameter is a time interval during which a rectified voltage is less than a predetermined voltage threshold, such that the time interval being more than a predetermined threshold interval is indicative that a dimmer circuit is present;

(b) the parameter is a voltage at an end of a predetermined delay from a predetermined phase of the mains cycle, such that the voltage being less than a predetermined threshold voltage is indicative that a dimmer circuit is present;

(c) the parameter is a second differential of the mains voltage, such that the parameter exceeding a predetermined absolute detection level is indicative that a dimmer circuit is present, and (d) the parameter is a second differential of the mains voltage, such that the parameter exceeding a predetermined absolute detection level is indicative that a dimmer circuit is present.

14. An LED lighting controller comprising an electronic ballast as claimed in claim 11.

* * * * *